United States Patent [19]

Wright

[11] 4,141,489

[45] Feb. 27, 1979

[54] SWINGING CARRIER CENTRIFUGE ROTOR

[75] Inventor: Herschel E. Wright, Santa Clara, Calif.

[73] Assignee: Beckman Instruments, Inc., Fullerton, Calif.

[21] Appl. No.: 847,879

[22] Filed: Nov. 2, 1977

[51] Int. Cl.[2] ..... B04B 5/02

[52] U.S. Cl. ..... 233/26

[58] Field of Search ..... 233/26, 27, 11, 1 R, 233/23 A

[56] References Cited

U.S. PATENT DOCUMENTS

| | | | |
|---|---|---|---|
| 2,202,157 | 5/1940 | Levy | 233/26 |
| 3,151,073 | 9/1964 | Anthon | 233/26 X |
| 3,850,368 | 11/1974 | Boeckeler | 233/26 X |
| 3,981,438 | 9/1976 | Weyant | 233/26 |
| 4,010,892 | 3/1977 | Revillet | 233/26 |

FOREIGN PATENT DOCUMENTS

| | | | |
|---|---|---|---|
| 296421 | 4/1954 | Switzerland | 233/26 |

*Primary Examiner*—George H. Krizmanich
*Attorney, Agent, or Firm*—R. J. Steinmeyer; F. L. Mehlhoff; W. H. May

[57] ABSTRACT

A rotor having a plurality of swinging carriers designed to receive specimen samples for subjection to centrifugation. The carriers are pivotally mounted to a rotor frame in such a manner that the generally flat support faces of each of the carriers assumes a parallel orientation with respect to the rotational axis of the rotor during operational speeds of the rotor. When the rotor is not operating, the support surfaces of each of the carriers assumes the perpendicular or acute angle orientation with respect to the rotational axis of the rotor. In order to overcome any resistive frictional forces which may be generated at the interface between the rotor frame and the pivoting carrier, the pivot axis of the carrier is shifted from the central or center of gravity plane of the carrier to ensure that the support surface of the carrier will positively assume its proper parallel orientation with the rotor spin axis. Means are incorporated into the carrier or the rotor to limit the swinging effect of the offset pivot axis of the carrier, so that the support face will not go beyond its parallel orientation with the spin axis. The present rotor device incorporates a holding means to maintain the support base of the carrier at an acute angle to the rotational axis of the rotor when the rotor is at rest.

2 Claims, 8 Drawing Figures

SWINGING CARRIER CENTRIFUGE ROTOR

BACKGROUND OF THE INVENTION

This invention relates to the field of centrifugal rotors and, more particularly, is related to the field of swinging carrier rotors or swinging bucket rotors.

With presently used swinging carrier rotors, the carrier generally has a rectangular shape designed to receive particular types of test tube racks, such as those that may be used in a radioimmunoassay instrument. Another type of swinging carrier rotor is a swinging bucket rotor where the bucket either contains a large specimen to be centrifugated or may contain an adapter to hold a plurality of smaller test tubes for subjection to centrifugation.

In any swinging carrier type centrifuge rotor the sample receptacles typically assume a vertical or close to vertical orientation when the rotor is at rest. In other words, the test tubes are in many cases generally parallel to the rotational axis of the rotor when the rotor is at rest, although in some cases the longitudinal axis of the test tubes may be at a slight acute angle to the rotational axis of the rotor. When the rotor reaches operational speeds during centrifugation, the swinging carrier or bucket will assume a second orientation, resulting in the longitudinal axis of each test tube generally assuming a perpendicular orientation with respect to the rotational axis of the rotor. The support base on which these test tube samples or test tubes rest generally assumes a parallel orientation with respect to the spin axis of the rotor when the rotor is at operational speed.

It is critical to successful centrifugation that the test tubes carrying the samples are as perpendicular as possible to the rotational axis of the rotor during centrifugation. In present configurations of swinging type centrifuge rotors there is friction at the interface of the pivotal carrier and the rotor frame which prevents the carrier from assuming its proper orientation with respect to the spin axis during the operational speed of the rotor. This would not only result in a possible unbalanced condition in the rotor, but also cause some samples within the carrier to be subjected to a different centrifugal field than others.

SUMMARY OF THE INVENTION

The present invention comprises the construction of the carrier in a swinging type rotor in such a manner that its central or center of gravity plane of the carrier in order to ensure that the carrier assumes the proper orientation with respect to the spin axis of the rotor during centrifugation. More specifically, the pivot axis of the carrier is offset from a perpendicular plane extending from the middle or geometric center of the longitudinal dimension of the support base of the carrier. Consequently, one half of the carrier with respect to the pivot axis is slightly heavier than the other. The half of the carrier closest to the spin axis of the rotor when the rotor is at rest is the heavier portion. When the centrifugal force is great enough to overcome the weight of the heavier portion, the carrier will be moved with greater force toward the proper orientation during centrifugation and overcome any friction forces which are generated between the interface of the carrier and the rotor frame.

During centrifugation, the center of gravity of the carrier is asymmetrical to or below the rotation plane of the pivot pins. The rotation plane is a horizontal plane perpendicular to the spin axis and in alignment with the pivot axis of the carrier. In prior art arrangements the center of gravity has generally been aligned with or symmetrical with the rotation plane.

Means are incorporated within the carrier or the rotor frame to limit the movement of the carrier once the proper parallel orientation has been achieved between the support base of the carrier and the rotational axis of the rotor. Otherwise, the carrier may overswing and not maintain its proper parallel orientation with the spin axis of the rotor.

Also incorporated within the present invention with respect to the swinging carrier rotor embodiment is a holding member which maintains the support base of the carrier at an acute angle with the rotational axis of the rotor when the rotor is at rest.

DETAILED DESCRIPTION OF THE INVENTION

Figure 1:
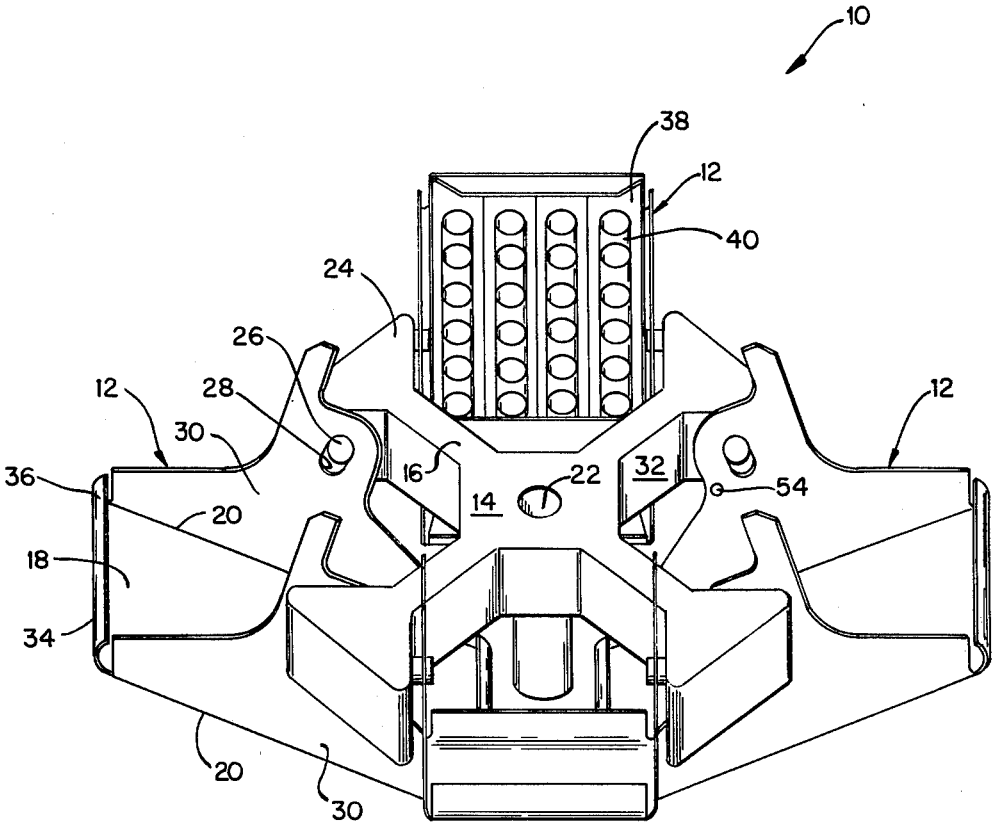
FIG. 1 is a perspective view of a swinging carrier rotor showing a plurality of carriers attached to a rotor frame with the rotor at rest.

A swinging carrier rotor 10 is shown in FIG. 1 having a plurality of carriers 12 which are pivotally mounted to a rotor frame 14, having a plurality of radially extending arms 16. Each of the carriers 12 has a support surface or base 18 which has a generally rectangular configuration with its longer edges 20 being oriented somewhat in a direction toward the rotational shaft or axis 22 of the rotor when the rotor is stationary. Located on the enlarged outer ends 24 of each of the rotor arms 16 are pivot pins 26 which are designed to engage with the receiving slots 28 in the side portions 30 of the carriers 12 for pivotally connecting each of the carriers 12 between adjacent pairs of radially extending arms 16 of the main rotor structure 14. Each adjacent pair of arms 16 of the rotor forms a yoke 32 which is designed to receive each carrier 12.

Each side or hanger portion 30 of the carriers has a generally triangular configuration and extends at essentially a right angle from the support base 18. Also along each of the narrower or shorter length edges 34 of the support base 18 is a raised flange portion 36 which is essentially at a right angle to the support base 18. The combination of the hanger portions 30 and the end flange portions 36 extending at right angles from or above the support base 18 provides a rimmed area in each carrier to receive a plurality of test tube racks 38 which carry a series of test tubes 40 holding specimens to be centrifugated. It should be noted that in FIG. 1 for the purpose of clarity only one carrier has a complement of test tube racks 38. The longitudinal axis of each rack 38 is oriented to be directed toward the rotational shaft 22 in FIG. 1 of the rotor 10 when they are inserted within the carriers 12. Consequently, the number of test tubes along the narrower edge 34 of the carrier 12 is limited to four in this case while the number of rows of test tubes along the longer edge 20 of the carrier will be considerably more. This particular orientation is important to help promote more uniformity among all the various test tubes with respect to the centrifugated load they will experience as will be explained more fully hereinafter.

Figure 2:
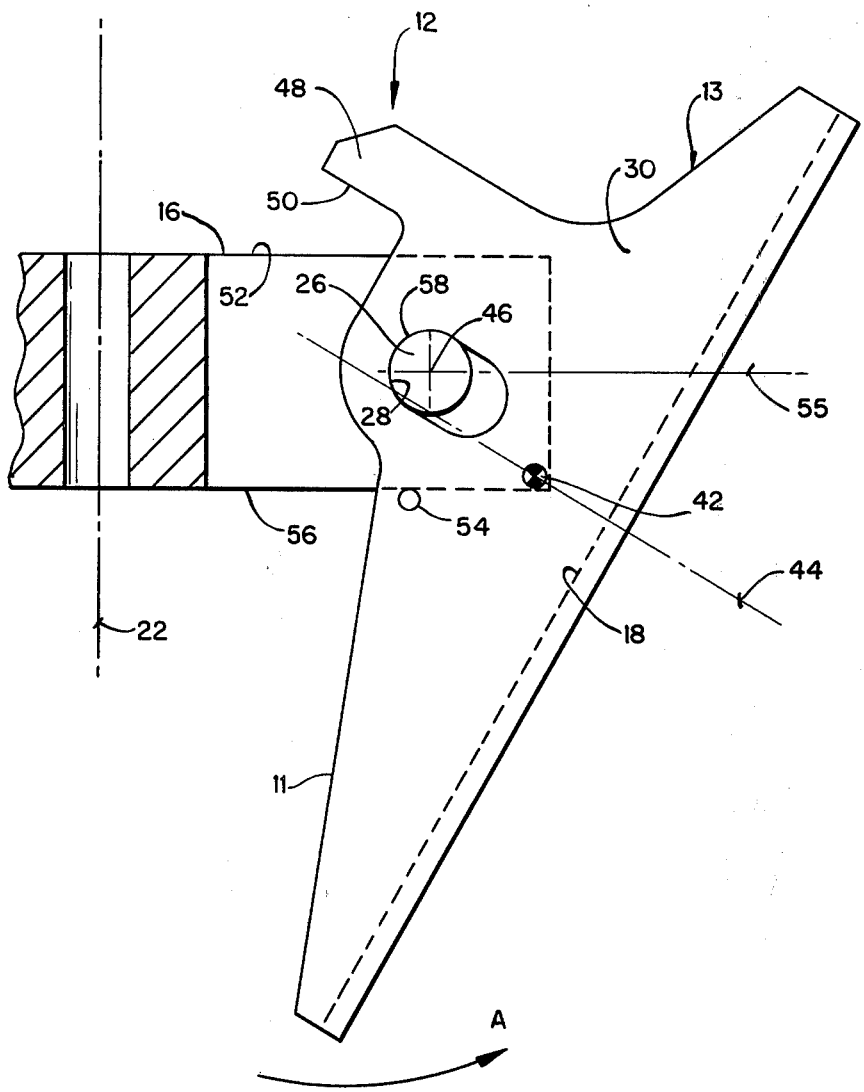
FIG. 2 is a side elevation view of one of the swinging carriers at rest mounted on the rotor frame.
Figure 3:
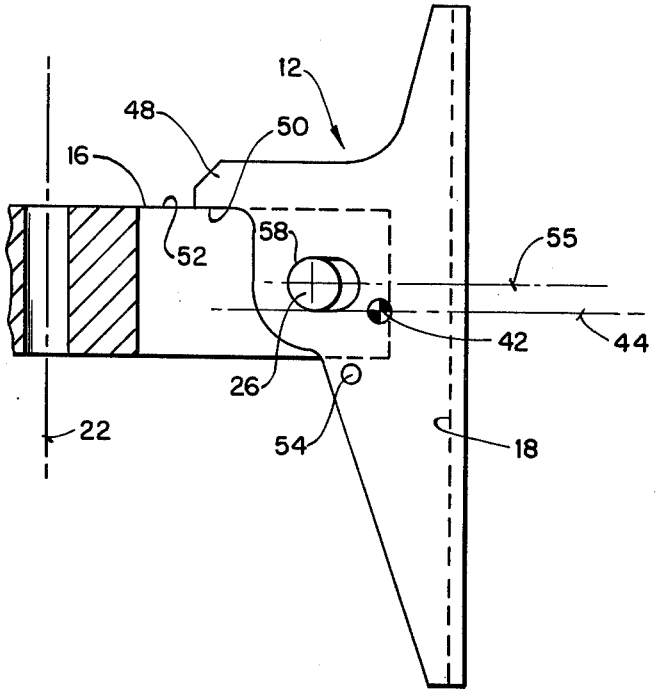
FIG. 3 is a side elevational view of a rotor carrier shown in FIG. 2 in a second orientation when the rotor is at operational speed.

With respect to FIG. 2 each of the carriers 12 is constructed in such a manner that its pivot axis 46 will be offset from a central plane 44 which extends perpendicularly from longitudinal center of the support base 18 of the carrier. Consequently, one side or portion 11 of the carrier 12 with respect to the plane of rotation 55 in FIG. 3 will be heavier than the other portion 13. As shown in FIG. 3, the center of gravity 42 of the carrier 12 is offset or asymmetrical to the plane of rotation 55 when the rotor is operational. In prior art arrangements the center of gravity is substantially aligned with or symmetrical to the plane of rotation 55 during centrifugation. It should be noted that during centrifugation the central plane 44 of FIG. 2 is not coincident, but parallel with the rotational plane 55 in FIG. 3.

During the operational speed of the rotor the weighted portion 11 of the carrier will respond to the rotation of the rotor with greater force than the lighter portion of the carrier to ensure that the carrier will attain the proper orientation of the support surface 18 parallel to the spin axis 22. This greater force of the heavier portion 11 of the carrier is the result of a greater centrifugal force necessary to overcome the weight of the heavier portion to move it in the direction of arrow A in FIG. 2. However, in order to prevent the overswing of the carrier beyond the parallel orientation between the support base 18 and the spin axis 22, a pair of stop arms 48 project from the carrier 12 with engaging surfaces 50 to contact the top surface 52 of the respective rotor arms 16 on which the carrier 12 is mounted.

When the rotor is at rest, a limit peg 54 mounted in the carrier 12 engages the bottom surface 56 of the rotor arm 16 to maintain an acute angle between the support base 18 of the carrier and the spin axis 22 of the rotor. This is necessary in view of the fact that the length of the support base 18 is too great to allow its assumption of a horizontal orientation.

Turning to the operation of the present invention reference is made to FIG. 2 showing the carrier 12 in its orientation with respect to the spin axis 22 when the rotor is at rest. Because of the existence of the limit peg 54 engaging the bottom surface 56 of the rotor arm 16, the support base 18 of the carrier 12 assumes an acute angle orientation with respect to the spin axis 22. As stated previously, the swinging carrier 12 is designed to assume a parallel orientation with respect to the spin axis 22 of the rotor during the operational speed of the rotor. However, at the interface junction 58 between the surface of the support peg 26 and the surface of the slot 28 the coefficient of friction may be great enough to prevent the support base of the carrier from assuming a complete parallel orientation with respect to the spin axis of the rotor. The design of the present invention has the pivot axis 46 of the carrier 12 offset from the central plane 44 of the carrier. Therefore, the greater weight on the lower portion 11 of the carrier 12 in FIG. 2 requires a greater centrifugal force to move the carrier 12 in a counterclockwise direction of the arrow A with respect to FIG. 2 when the rotor reaches operational speed. Therefore, the greater force moving the carrier 12 in a counterclockwise direction will overcome any friction forces which may develop at the interface 58 between the support pin 26 and the slot 28 in the carrier. During the operation of the rotor, as shown in FIG. 3, the center of gravity 42 is below or offset from the rotation plane 55 of the rotor.

Because of the offset position of the pivot axis 46 of the carrier 12 with respect to rotation plane of the support pin 26, the carrier 12 may tend to overswing and go beyond the proper orientation of the support base 18 being parallel to the spin axis 22. Therefore, the engagement of the contact surfaces 50 of the stop arms 48 against the top surface 52 of the rotor arm 16 prevents any overswing of the carrier 12 and maintains the proper parallel orientation between the support base 18 and the spin axis 22.

Reference is made to FIG. 3 showing the contact of the surfaces 50 against the top surface 52 of the rotor arm 16 to prevent any overswing of the carrier 12 and maintain the proper parallel orientation between the support surface 18 of the carrier and the spin axis 22 of the rotor.

Figure 4:
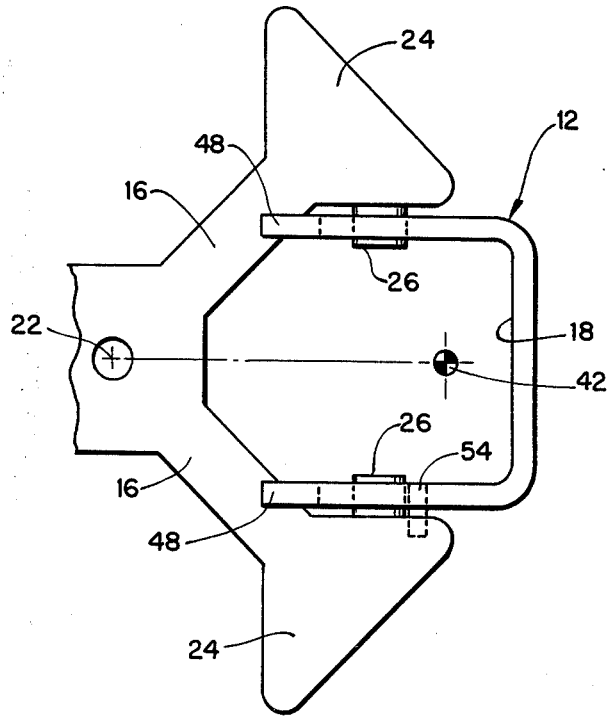
FIG. 4 is a top plane view of the carrier as shown in FIG. 3 with the rotor at operational speed.

FIG. 4 shows the engagement between the stop arms 48 and the carrier 12 as they contact the top surface 52 of each of the rotor arms 16.

Figure 5:
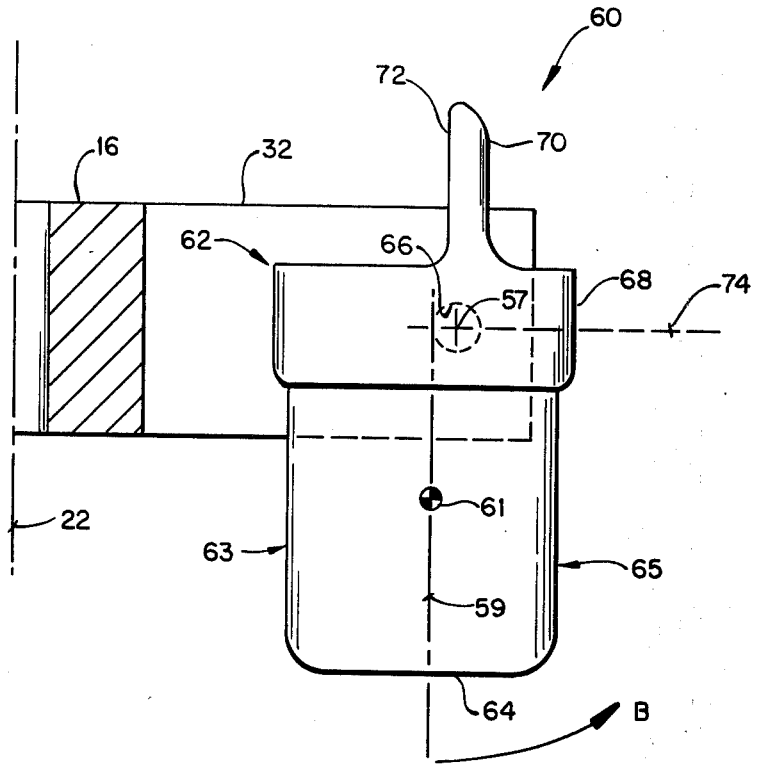
FIG. 5 is a side elevational view showing a swinging bucket rotor with one bucket attached to the rotor when the rotor is at rest.
Figure 6:
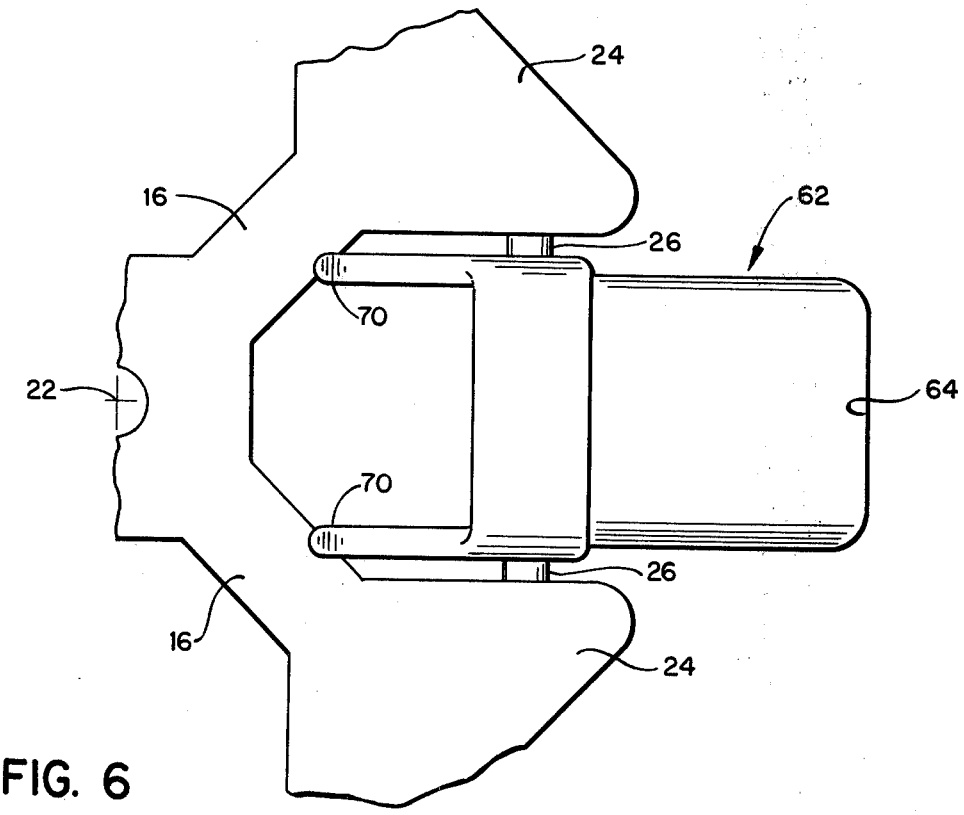
FIG. 6 is a top plane view of the bucket as shown in FIG. 5 with the rotor at operational speed.

Reference is made to FIG. 5 showing another swinging carrier or bucket type rotor 60 with one bucket 62 in the rest position with respect to the rotor arm 16. The bucket is constructed in such a manner that the pivot axis 57 of the bucket is shifted or offset from the central plane 59 of the bucket so that the side or portion 63 of the bucket closest the spin axis 22 of the rotor would be heavier than the other side or portion 65 of the bucket away from the spin axis 22. Consequently, when the bucket is at rest there would be a slight tilt in the bucket with the bottom or support base 64 of the bucket being tilted away from the spin axis 22. However, this tilt is minimal. During centrifugation the offset of the pivot axis in the bucket requires a greater centrifugal force to move the bucket in the direction of the arrow B. This would provide the necessary greater force to overcome any friction forces which may be generated between the support pins 26 and the support slots 66 in the bucket 62. Extending from the top portion 68 of the bucket 62 are a pair of stop arms 70 in FIGS. 5 and 6 similar to the stop arms 48 in the carrier 12 of FIG. 2. Each stop arm 70 has an engaging surface 72 designed to contact the top surface 52 of the respective rotor arms 16. Therefore, the stop arms 70 would prevent any overspin of the bucket 62 when the rotor is at operational speed. The center of gravity 61 of the bucket will be below or asymmetrical to the rotation 74 of the pivot pins 26 when the bucket 62 pivots to its extended position during centrifugation.

The present invention is to utilize the construction of a swinging carrier in such a manner that its pivot axis is offset from the geometric center of the carrier, so that the greater centrifugal force exerted on the carrier will cause it to overcome any frictional forces which may exist at the interface between the carrier and the support pins in the rotor. This will ensure that the fluid samples to be subjected to centrifugation will assume their proper orientation with respect to the spin axis of the rotor and ensure that all samples within the carrier will be subjected to the same centrifugal field. In addition, the proper orientation of the carrying member with respect to the spin axis ensures that there will be the best possible balanced condition for the rotor during its operational speeds.

As stated previously, with respect to the carriers 12 as shown in FIGS. 1 and 2 a limit peg 54 is utilized to maintain the accute angle orientation between the support base 18 and the spin axis 22 when the rotor is at rest. This acute angle orientation of the carriers enables the outer diameter or centrifugal dimension of the rotor to be substantially smaller than if the carriers 12 are allowed to pivot to a complete horizontal position when the rotor is stationary. This feature becomes very important with respect to being able to accommodate smaller centrifuges with a rotor that is able to carry considerably more test tube samples within a confined space than those rotors which require the test tube carrier to come to a complete horizontal position subsequent to centrifugation. Although the test tubes 40 will be oriented at an angle with respect to the horizontal reference when the rotor comes to rest, necessitating a slight reduced volume of the specimen within each of the test tubes to accommodate the possibility of spillage, this reduced volume is very minimal with respect to the increased amount of overall specimens which can be incorporated within the smaller rotor chamber.

Figure 7:
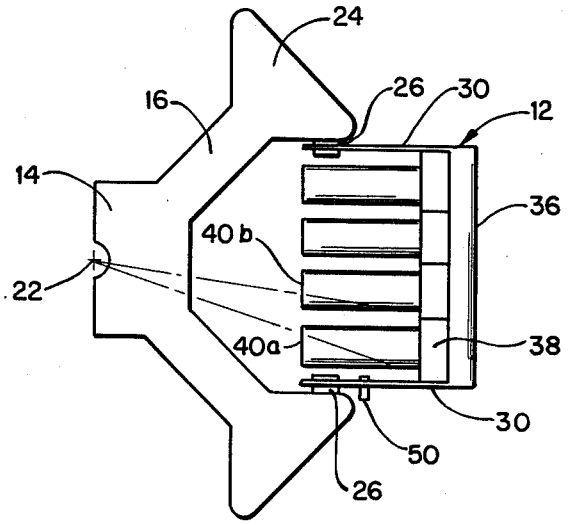
FIG. 7 is a top plane view of a swinging carrier of the present invention during rotation with the narrow dimension of the carrier between the pivot points.
Figure 8:
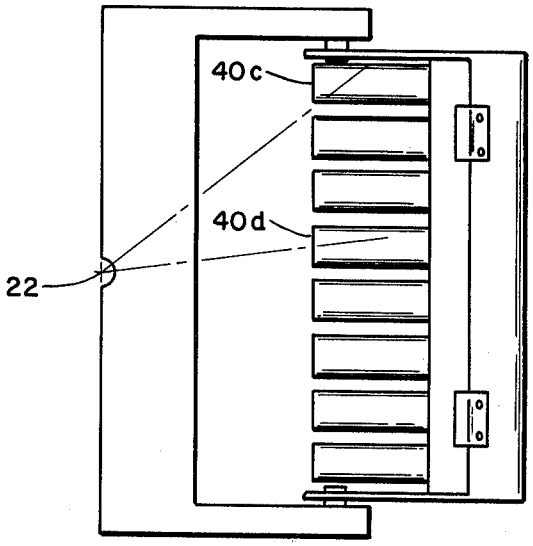
FIG. 8 is a top plane view of a prior art swinging carrier during rotation with the longer dimension of the carrier between the pivot points.

The particular orientation of the carriers 12 generally achieves the object of having as uniform as possible a centrifugally induced load on each of the various test tubes in each of the carriers as compared to the presently used types of swinging carrier type rotors wherein the rectangular orientation of the carrier supported within the rotor is displaced 90° with respect to the present invention. Since there are a maximum of only four racks 38 of test tubes in the carrier 12 as shown in FIG. 7, the carrier 12 being in its centrifugation orientation, the radial distance between the rotational shaft 22 of the rotor and the test tube 40A and the radial distance between the rotational shaft 22 of the rotor and the test tube 40B is much smaller than the distance would be if the rectangular carrier were oriented in a 90° displaced position as shown in FIG. 8. This prior art orientation as shown in FIG. 8 causes the distance between the rotational shaft 22 of the rotor and the test tube 40C and the distance between the rotational shaft 22 and the test tube 40D to be much greater than in the case of the orientation of the present invention as shown in FIG. 7 with respect to test tubes 40A and 40B.

Therefore, the centrifugally induced loading experienced by the test tube 40A is not significantly greater than the loading experienced by the test tube 40B while the loading experienced by the test tube 40C is significantly greater than the loading experienced by the test tube 40D. The difference is such that it would be possible in some cases that the centrifugally induced loading experienced by the test tube 40C would be great enough to result in failure in that particular test tube. Further, there is a problem of great discrepancy in the characteristics of the centrifugated pellet within each of the samples due to the disparity in the centrifugal force on each of the test tubes.

What is claimed is:

1. A swinging carrier rotor comprising:

a rotor frame having a plurality of radially extending arms forming at least two yoke portions;

at least two carriers for holding a plurality of specimen containers, said carriers having a support base;

means for pivotally mounting each of said carriers within said yoke portions of said rotor frame in such a manner that the pivot axis of each of said carriers is asymmetrical with the geometric central plane of the carrier so that, when said rotor frame is rotating at operational speed, the pivot plane of said carrier is above the central plane of said carrier to insure that said support base of each of said carriers will always assume an orientation parallel to the spin axis of said rotor to overcome friction forces between said carrier and said mounting means as said carrier moves relative to said rotor frame; and a projection extending from the top of each of said carriers, said projection contacting one of said radially extending arms of said rotor frame when said rotor is at operational speed to prevent said asymmetrical pivot axis of each of said carriers in conjunction with the centrifugal forces from moving each of said support bases beyond said parallel relation with said spin axis.

2. A rotor as defined in claim 1, wherein said carrier support base is rectangular for receipt of a plurality of tube racks, said rotor additionally comprising a limit peg mounted on one of said carrier and said rotor frame, said limit peg extending sufficiently from one of said carrier and said rotor frame to contact the other of said carrier and said rotor when said carrier assumes its position relative to said rotor frame when said rotor is at rest to limit the outer dimensional size of said rotor frame and said carriers.

* * * * *